US007411443B2

(12) United States Patent
Ivanov et al.

(10) Patent No.: US 7,411,443 B2
(45) Date of Patent: Aug. 12, 2008

(54) PRECISION REVERSED BANDGAP VOLTAGE REFERENCE CIRCUITS AND METHOD

(75) Inventors: Vadim Valerievich Ivanov, Tucson, AZ (US); Keith Eric Sanborn, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/472,791

(22) Filed: Jun. 22, 2006

(65) Prior Publication Data

US 2007/0126495 A1 Jun. 7, 2007

Related U.S. Application Data

(60) Provisional application No. 60/741,944, filed on Dec. 2, 2005, provisional application No. 60/745,118, filed on Apr. 19, 2006.

(51) Int. Cl.
*G05F 1/10* (2006.01)

(52) U.S. Cl. ..... 327/539

(58) Field of Classification Search ..... 327/535, 327/537, 539

See application file for complete search history.

(56) References Cited

U.S. PATENT DOCUMENTS 6,046,578 A 4/2000 Feldtkeller
6,294,902 B1 9/2001 Moreland et al.
6,844,772 B2 * 1/2005 Hoon et al. ..... 327/541
6,906,581 B2 6/2005 Kang et al.
6,943,617 B2 9/2005 Tran et al.
7,019,584 B2 * 3/2006 Bartel et al. ..... 327/539
7,053,694 B2 * 5/2006 Ozawa ..... 327/539
7,224,210 B2 * 5/2007 Garlapati et al. ..... 327/539
2005/0231270 A1 10/2005 Washburn

OTHER PUBLICATIONS

"Low Voltage Techniques" by Robert J. Widlar, IEEE Journal of Solid-State Circuits, vol. SC-13, No. 6, Dec. 1978, pp. 838-846.
"A CMOS Bandgap Reference Circuit with Sub-1-V Operation" by Banba et al., IEEE Journal of Solid-State Circuits, vol. 34, No. 5, May 1999, pp. 670-674.
"Curvature-Compensated BiCMOS Bandgap with I-V Supply Voltage" by Malcovati et al., IEEE Journal of Solid-State Circuits, vol. 36, No. 7, Jul. 2001, pp. 1076-1081.

* cited by examiner

*Primary Examiner*—Jeffrey S Zweizig
(74) *Attorney, Agent, or Firm*—Warren L. Franz; Wade J. Brady, III; Frederick J. Telecky, Jr.

(57) ABSTRACT

A circuit producing a reversed bandgap reference voltage circuit $V_{RBG}$ includes first and second resistors coupled as a voltage divider between ground and a first conductor, a base of a first transistor being coupled to the voltage divider to produce a first voltage $V_{BE1}(1+1/M)$ between the first conductor and ground, M being a ratio of the resistances of the first and second resistors. A third resistor is coupled between a base of the second transistor and ground to produce a second voltage $V_{BE2}+V_{RBGP}$ between the second conductor and ground. First circuitry forces the collector current of the first transistor to be equal to the collector current of the second transistor, and second circuitry forces the first voltage $V_{BE1}(1+1/M)$ to be equal the second voltage $V_{BE2}+V_{RBGP}$. One of the first circuitry and second circuitry includes an operational amplifier coupled to effectuate the forcing.

20 Claims, 5 Drawing Sheets

PRECISION REVERSED BANDGAP VOLTAGE REFERENCE CIRCUITS AND METHOD

CROSS REFERENCE TO RELATED APPLICATIONS

This application claims the benefit of prior filed co-pending U.S. provisional application Ser. No. 60/741,944 filed Dec. 2, 2005, entitled "Precision voltage reference with sub-1 volt output value and supply capability" by Vadim Valerievich Ivanov and Keith Eric Sanborn, and incorporated herein by reference.

This application also claims the benefit of prior filed co-pending U.S. provisional application Ser. No. 60/745,118 filed Apr. 19, 2006, entitled "Bandgap Voltage References with 1V Supply" by Vadim Valerievich Ivanov and Keith Eric Sanborn, and incorporated herein by reference.

BACKGROUND OF THE INVENTION

The present invention relates generally to reversed bandgap voltage reference circuits, and more particularly to reversed bandgap voltage reference circuits which are capable of operating from power supply voltages of less than 1 volt and also are more accurate than those of the prior art.

Traditional bandgap voltage reference circuits (see D. A. Johns and K. Martin, "Analog Integrated Circuit Design", Wiley, 1997, page 357) provides Vout approximately equal to 1.2 volts with less than 50 ppm/degrees Centigrade temperature coefficient (TC) and better than 2% scattering of the output voltage in production volumes without the need for trimming of resistor values. Since the output bandgap voltage is approximately 1.2 volts, the disclosed bandgap reference voltage circuit can not operate from supply voltages below approximately 1.3V.

FIG. 1 illustrates a conventional bandgap reference voltage circuit which includes a PNP transistor Q1 having its base and collector connected to ground, with its emitter receiving a current from a P-channel transistor 6 of a current mirror circuit also including P-channel transistors 5 and 7. PNP transistor Q2 has an emitter area that is N times greater than that of transistor Q1. The base and emitter of transistor Q2 are connected to ground, and its emitter is coupled by a resistor 4 to receive a current from P-channel current mirror transistor 7 equal to the current supplied by transistor 6 to transistor Q1. The emitter of transistor Q1 is connected to the (−) input of operational amplifier 1, and the upper terminal of resistor 4 is connected to the (+) input of operational amplifier 1. The difference in the base-emitter voltages $V_{BE1}$ and $V_{BE2}$ of transistors Q1 and Q2, respectively, due to the scaling ratio N of their emitter areas is equal to the voltage across resistor 4 and is used to generate the output bandgap reference voltage Vref. The circuit of FIG. 1 is capable of operation from a 1 volt power supply. A relatively large amount of 1/f noise is generated in the current mirror transistors is in the feedback loop and therefore causes large corresponding noise errors in the generated output voltage Vref. Consequently, a large external filter capacitance is needed to limit the noise bandwidth.

To satisfy the growing need for reference voltage circuits capable of functioning at lower supply voltages, various other attempts have been made to create circuits based on temperature properties of the threshold $V_{TH}$ and carrier mobility μ of the MOS transistor. (See I. M. Filanovsky, A. Allam, "Mutual Compensation of Mobility and Threshold Voltage Temperature Effects with Applications in CMOS Circuits", IEEE TCAS-I, vol. 48, no. 7, pp. 876-884, 2001). However, relatively poor manufacturing repeatability and poor control of the process-defined VGS threshold voltage $V_{TH}$ prevents the circuits disclosed in these references from being widely adopted by the industry. Accuracy and production "scattering" of such bandgap reference voltage circuits are significantly worse than for the traditional bandgap reference voltage circuit shown in FIG. 1.

FIG. 2 shows a known current mode bandgap reference voltage circuit which includes an NPN transistor Q1 having its emitter connected to ground, its base connected to one terminal of a resistor R1 having its other terminal connected to ground. The collector of transistor Q1 is connected to Vref and to the emitter of a diode-connected NPN transistor Q2 having an emitter area that is N times that of transistor Q1. The base and collector of transistor Q2 are connected to one terminal of a current source and to one terminal of a resistor R2, the other terminal of which is connected to the base of transistor Q1. This circuit has the shortcomings that transistor Q1 operates close to saturation and therefore the circuit is subject to errors caused by large base currents. This circuit also requires the current source Ibias to be a complicated circuit capable of providing a complicated temperature coefficient.

Various other attempts also have been made to create bandgap reference voltage circuits based on current-mode operation, by combining positive-TC and negative-TC current sources to create a temperature independent current. This current is transferred to a resistor by a current mirror to generate the reference voltage. (See P. Malcovati, F. Maloberti, C. Fiocci, and M. Pruzzi, "Curvature-compensated BiCMOS bandgap with 1-V supply voltage", IEEE JSSC, vol. 36, no. 7, pp. 1076-1081, 2001). However, the main drawback of the current-mode reference voltage circuits disclosed in these references is the presence of the current mirror. Regardless of the circuit techniques and components used to create the positive-TC and negative-TC currents, the accuracy of such reference can not be better than accuracy of the current mirror and the resistor (considering matching and noise). In general, an improvement in current mirror accuracy can be achieved with sampling techniques. The noise can be reduced by using a large filtering capacitor at the output. However, this leads to a more complicated circuit, larger die area and increased current consumption, with somewhat compromised accuracy.

An attempt been made to use what is referred to herein as a "reversed bandgap principle", using NPN transistors in FIG. 2 of "A CMOS Bandgap Reference Circuit with Sub-1-V Operation" by H. Banba, H. Shiga, A. Umezawa, T. Miyaba, T. Tanzawa, S. Atsumi, and K. Sakui, IEEE JSSC, vol. 34, no. 5, pages 670-674, 1999. Also see FIG. 4 of "Low Voltage Techniques" by R. J. Widlar, IEEE JSSC, vol. 13, no. 6, pages 838-846, 1978.

The voltage reference in FIG. 2 of the Banba reference using the "reversed bandgap principle" has been implemented with NPN transistors. One of the core NPN transistors operates with ~190 millivolts collector-to-emitter voltage (VCE). Being that close to saturation, the parasitic substrate PNP structure, which is present in vertical NPN transistors on all but SOI (silicon on insulator) processes, becomes activated. This in turn increases the value of the base current and decreases its predictability. This circuit also requires a separate bias with a complicated TC. As a result, the accuracy is poor and this reference voltage circuit cannot compete with traditional bandgap reference voltage circuits at higher supply voltages.

Thus, there is an unmet need for a reversed bandgap voltage reference circuit which provides a more precise reference voltage than has been previously obtainable from reference voltage circuits capable of operating from power supply voltages of less than 1 volt.

There also is an unmet need for a reversed bandgap voltage reference circuit which provides a more precise reference voltage having substantially lower noise than has been previously obtainable from reference voltage circuits capable of operating from power supply voltages of less than 1 volt.

There also is an unmet need for a reversed bandgap voltage reference circuit which provides a more precise reference voltage having substantially lower noise than has been previously obtainable from reference voltage circuits capable of operating from power supply voltages of less than 1 volt and which avoids the need for providing complex current source circuitry to compensate for temperature coefficient errors.

SUMMARY OF THE INVENTION

It is an object of the invention to provide a reversed bandgap voltage reference circuit which provides a more precise reference voltage than has been previously obtainable from reference voltage circuits capable of operating from power supply voltages of less than 1 volt.

It is another object of the invention to provide a reversed bandgap voltage reference circuit which provides a more precise reference voltage having substantially lower noise than has been previously obtainable from reference voltage circuits capable of operating from power supply voltages of less than 1 volt.

It is another object of the invention to provide a reversed bandgap voltage reference circuit which provides a more precise reference voltage having substantially lower noise than has been previously obtainable from reference voltage circuits capable of operating from power supply voltages of less than 1 volt and which avoids the need for providing complex current source circuitry to compensate for temperature coefficient errors.

Briefly described, and in accordance with one embodiment, the present invention provides a circuit producing a reversed bandgap reference voltage circuit $V_{RBG}$ including first (R1) and second (R2) resistors coupled as a voltage divider between ground and a first conductor (17), a base of a first transistor (Q1) being coupled the voltage divider to produce a first voltage $V_{BE1}(1+1/M)$ between the first conductor and ground, M being a ratio of the resistances of the first and second resistors. A third resistor (R4) is coupled between a base of the second transistor and ground to produce a second voltage $V_{BE2}+V_{RBGP}$ between the second conductor and ground. First circuitry forces the collector current ($I_{C1}$) of the first transistor (Q1) to be equal to the collector current ($I_{C2}$) of the second transistor (Q2), and second circuitry forces the first voltage $V_{BE1}(1+1/M)$ to be equal the second voltage $V_{BE2}+V_{RBGP}$. One of the first circuitry and second circuitry includes an operational amplifier coupled to effectuate the forcing.

In one embodiment, a circuit for producing a reversed bandgap reference voltage $V_{RBGP}$ includes a first transistor (Q1) and a second transistor (Q2) having an emitter area substantially greater than that of the first transistor (Q1). First (R1) and second (R2) resistors are coupled in series between a reference voltage conductor (GND) and a first conductor (17 in FIGS. 4A,B or 17A in FIGS. 5A,B) and a base of the first transistor (Q1) is coupled to a junction (32A) between the first and second resistors, to produce a first voltage $V_{BE1}(1+1/M)$ between the first conductor (17 or 17A) and the reference voltage conductor (GND), wherein $V_{BE1}$ is the base-emitter voltage of the first transistor (Q1) and M is a ratio of the resistances of the first (R1) and second (R2) resistors. A third resistor (R4 in FIGS. 4B,5A,B or R5 in FIG. 4A) across which the reversed bandgap reference voltage $V_{RBGP}$ is produced is coupled between a base of the second transistor (Q2) and the reference voltage conductor (GND) and a second conductor (17 in FIGS. 4A,B or 17B in FIGS. 5A,B) to produce a second voltage $V_{BE2}+V_{RBGP}$ between the second conductor (17 or 17B) and the reference voltage conductor (GND), wherein $V_{BE2}$ is the base-emitter voltage of the second transistor (Q1). First circuitry is coupled to effectuate forcing the collector current ($I_{C1}$) of the first transistor (Q1) to be equal to the collector current ($I_{C2}$) of the second transistor (Q2), and second circuitry is coupled to effectuate forcing the first voltage $V_{BE1}(1+1/M)$ to be equal the second voltage $V_{BE2}+V_{RBGP}$. In all but one of the disclosed embodiments, at least one of the first circuitry and second circuitry includes an operational amplifier coupled to effectuate the forcing.

In one embodiment, the first (Q1) and second (Q2) transistors are NPN transistors, an emitter of the second transistor (Q2) is coupled to a first terminal of the third resistor (R5) by means of a conductor conducting the reversed bandgap reference voltage $V_{RBGP}$, a second terminal of the third resistor (R5) is coupled to the reference voltage conductor (GND), and an emitter of the first transistor (Q1) is coupled to the reference voltage conductor (GND). The first circuitry includes a first operational amplifier (12), a P-channel transistor (M1) having a gate coupled to an output of the first operational amplifier (12) and a drain coupled by the first conductor (17) to a first terminal of a fourth resistor (R3) and a first terminal of a fifth resistor (R4). The fourth resistor (R3) has a second terminal coupled to a collector of the first transistor (Q1) and a first input of the first operational amplifier (12). The fifth resistor (R4) has a second terminal coupled to a collector of the second (Q2) transistor and a second input of the first operational amplifier (12). The second circuitry includes the first conductor (17) coupled to a base of the second transistor (Q2).

In another embodiment, the first (Q1) and second (Q2) transistors are PNP transistors, a collector of the first transistor (Q1) is coupled to a first terminal of a fourth resistor (R3), a collector and a base of the second transistor (Q2) are coupled to the first terminal of the third resistor (R4) by means of a conductor conducting the reversed bandgap reference voltage $V_{RBGP}$, emitters of the first (Q1) and second (Q2) transistors are coupled to the first conductor (17). The first circuitry includes a first operational amplifier (12), a P-channel transistor (M1) having a gate coupled to an output of the first operational amplifier (12) and a drain coupled to the first conductor (17). The third (R4) and fourth (R3) resistors each have a second terminal coupled to the reference voltage conductor (GND). The first terminal of the third resistor (R4) is coupled to a first input of the first operational amplifier (12), and the first terminal of the fourth resistor (R3) is coupled to a second input of the first operational amplifier.(12). The second circuitry includes the first conductor (17) connected to the emitters of the first (Q1) and second (Q2) transistors.

In another embodiment, the first (Q1) and second (Q2) transistors are PNP transistors, emitters of the first (Q1) and second (Q2) transistors are coupled to the first (17A) and second (17B) conductors, respectively. A collector of the first transistor (Q1) is coupled to the reference voltage conductor (GND), a base and collector of the second transistor (Q2) are coupled by means of a conductor conducting the reversed bandgap reference voltage $V_{RBGP}$ to a first terminal of a third resistor (R4), and a second terminal of the third resistor (R4) is coupled to the reference voltage conductor (GND). The first circuitry includes matched first (M1) and second (M2)

P-channel transistors. The second circuitry includes a first operational amplifier (12), the first (M1) and second (M2) P-channel transistors having gates coupled to an output of the first operational amplifier (12). The first P-channel transistor (M1) has a drain coupled by the first conductor (17A) to a first input of the first operational amplifier (12), and the second P-channel transistor (M2) has a drain coupled by the second conductor (17B) to a second input of the first operational amplifier (12). In that described embodiment, a matching resistance (R2A,R1A) equal to a series resistance of the first (R1) and second (R2) resistors may be coupled between the second conductor (17B) and the reference voltage conductor (GND).

In another embodiment, the first (Q1) and second (Q2) transistors are NPN transistors, collectors of the first (Q1) and second (Q2) transistors are coupled to the first (17A) and second (17B) conductors, respectively, an emitter of the first transistor (Q1) being coupled to the reference voltage conductor (GND), an emitter of the second transistor (Q2) being coupled by means of a conductor conducting the reversed bandgap reference voltage $V_{RBGP}$ to a first terminal of a third resistor (R4). A second terminal of the third resistor (R4) is coupled to the reference voltage conductor (GND), and a base and collector of the second transistor (Q2) are coupled to the second conductor (17B). The first circuitry includes matched first (M1) and second (M2) P-channel transistors. The second circuitry includes a first operational amplifier (12), the first (M1) and second (M2) P-channel transistors having gates coupled to an output of the first operational amplifier (12). The first P-channel transistor (M1) has a drain coupled by the first conductor (17A) to a first input of the first operational amplifier (12), and the second P-channel transistor (M2) has a drain coupled by the second conductor (17B) to a second input of the first operational amplifier (12). The first circuitry may include a matching resistance (R2A,R1A) equal to a series resistance of the first (R1) and second (R2) resistors coupled between the second conductor (17B) and the reference voltage conductor (GND).

In another embodiment, the first (Q1) and second (Q2) transistors are PNP transistors, emitters of the first (Q1) and second (Q2) transistors are coupled to the first (17A) and second (17B) conductors, respectively, collectors of the first (Q1) and second (Q2) transistors being coupled to the reference voltage conductor (GND). A base of the second transistor (Q2) is coupled by means of a third conductor (34B) conducting the reversed bandgap reference voltage $V_{RBGP}$ to a first terminal of a third resistor (R4) and a first terminal of a fourth resistor (R5). A second terminal of the third resistor (R4) is coupled to the reference voltage conductor (GND). The first circuitry includes matched first (M1) and second (M2) P-channel transistors and a third P-channel transistor (M3) and a first operational amplifier (12). The first (M1), second (M2) and third (M3) P-channel transistors have gates coupled to an output of the first operational amplifier (12). A drain of the third P-channel transistor (M3) is coupled by a fourth conductor (34A) to a first input of the first operational amplifier (15) and to a first terminal of a fifth resistor (R6) having a second terminal coupled to the ground reference voltage (GND). A second input of the first operational amplifier (15) is coupled to the third conductor (34B). The second circuitry includes a second operational amplifier (15), the first P-channel transistor (M1) having a drain coupled by the first conductor (17A) to a first input of the second operational amplifier (15). The second P-channel transistor (M2) has a drain coupled by the second conductor (17B) to a second input of the second operational amplifier (15). In output of the second operational amplifier (15) is coupled to a second terminal of the fourth resistor (R5) by means of an output conductor conducting a scaled-up voltage (Vref) representative of the reversed bandgap voltage $V_{RGBP}$.

In another embodiment, the first (Q1) and second (Q2) transistors are PNP transistors, emitters of the first (Q1) and second (Q2) transistors being coupled to the first conductor (17). A collector of the first transistor (Q1) is coupled to a first terminal of a fourth resistor (R6). A collector of the second transistor (Q2) is coupled to a first terminal of a fifth resistor (R7). The first circuitry includes a first operational amplifier (12), a P-channel transistor (M1) having a gate coupled to an output (19) of the first operational amplifier (12) and a drain coupled to the first conductor (17). The third (R4), fourth (R3), and fifth (R7) resistors each have a second terminal coupled to the reference voltage conductor (GND). The first terminal of the fourth resistor (R6) is coupled to a first input of the first operational amplifier (12). The first terminal of the first resistor (R1) is coupled to a base of the first transistor (Q1) and a second input of the first operational amplifier (12). The circuitry also includes a second operational amplifier (15) having a first input coupled to the first terminal of the fourth resistor (R6) and a second input coupled to the first terminal of the fifth resistor (R7). In output of the second operational amplifier (15) is coupled to a first terminal of a sixth resistor (R5) by means of a conductor conducting a scaled-up voltage (Vref) representative of the reversed bandgap voltage $V_{RBGP}$.The sixth resistor (R5) has a second terminal coupled to the first terminal of the third resistor (R4). The second circuitry includes the first conductor (17) connected to the emitters of the first (Q1) and second (Q2) transistors.

In all embodiments of the invention, the value of the third resistor is sufficiently low to prevent saturation of the second transistor (Q1).

In one embodiment, the invention provides a method for producing a reversed bandgap reference voltage $V_{RBGP}$, including providing a first transistor (Q1) and a second transistor (Q2) having an emitter area substantially greater than that of the first transistor (Q1), producing a first voltage $V_{BE1}$ (1+1/M) between a first conductor (17 in FIGS. 4A,B or 17A in FIGS. 5A,B) and a reference voltage conductor (GND), wherein $V_{BE1}$ is the base-emitter voltage of the first transistor (Q1) and M is a ratio of the resistances of first (R1) and second (R2) resistors coupled in series between the reference voltage conductor (GND) and the first conductor (17 in FIGS. 4A,B or 17A in FIGS. 5A,B). The method includes a second voltage $V_{BE2}+V_{RBGP}$ between a second conductor (17 in FIGS. 4A,B or 17B in FIGS. 5A,B) and the reference voltage conductor (GND), wherein $V_{BE2}$ is the base-emitter voltage of the second transistor (Q1), a third resistor (R4 in FIG. 4B or R5 in FIG. 4A) across which the reversed bandgap reference voltage $V_{RBGP}$ is produced being coupled between a base of the second transistor (Q2) and the reference voltage conductor (GND). The collector current ($I_{C1}$) of the first transistor (Q1) is forced to be equal to the collector current ($I_{C2}$) of the second transistor (Q2), and the first voltage $V_{BE1}(1+1/M)$ is forced to be equal to the second voltage $V_{BE2}+V_{RBGP}$. Each of the first (Q1) and second (Q2) transistors is prevented from operating in its saturated region.

In one embodiment, the invention provides circuit for producing a reversed bandgap reference voltage $V_{RBGP}$, including a first transistor (Q1) and a second transistor (Q2) having an emitter area substantially greater than that of the first transistor (Q1), means for producing a first voltage $V_{BE1}(1+1/M)$ between a first conductor (17 in FIGS. 4A,B or 17A in FIGS. 5A,B) and a reference voltage conductor (GND), wherein $V_{BE1}$ is the base-emitter voltage of the first transistor (Q1) and M is a ratio of the resistances of first (R1) and second (R2) resistors coupled in series between the reference voltage conductor (GND) and the first conductor (17 in FIGS. 4A,B or 17A in FIGS. 5A,B), means for producing a second voltage $V_{BE2}+V_{RBGP}$ between a second conductor (17 in FIGS. 4A,B or 17B in FIGS. 5A,B) and the reference voltage conductor (GND), wherein $V_{BE2}$ is the base-emitter voltage of the second transistor (Q1), a third resistor (R4 in FIG. 4B or R5 in FIG. 4A) across which the reversed bandgap reference voltage $V_{RBGP}$ is produced being coupled between a base of the second transistor (Q2) and the reference voltage conductor (GND), means for forcing the collector current ($I_{C1}$) of the first transistor (Q1) to be equal to the collector current ($I_{C2}$) of the second transistor (Q2), and means for forcing the first voltage $V_{BE1}(1+1/M)$ to be equal to the second voltage $V_{BE2}+V_{RBGP}$.

DETAILED DESCRIPTION OF THE PREFERRED EMBODIMENTS

The invention provides a number of reversed bandgap reference voltage circuits which provide low, stable reference voltages that are proportional to absolute temperature and have lower noise than the prior art, are more accurate than the prior art, and are capable of operation from a supply voltage less than 1 volt.

The traditional bandgap reference output voltage is equal to $$V_{BGP}=V_{BE}+M*V_{PTAT}=1.2 \text{ volts}, \quad \text{Eq. (1)}$$

where M is the gain coefficient of the proportional-to-absolute-temperature voltage $V_{PTAT}$. This voltage is generated from the difference between the base-emitter voltages ($V_{BE}$ voltages) of two bipolar transistors having different current densities.

Figure 3:
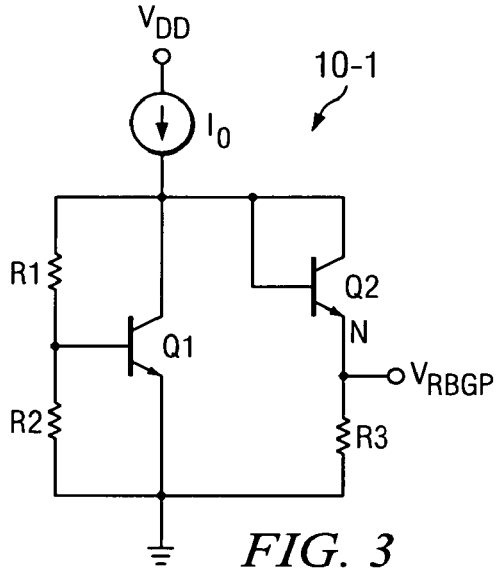
FIG. 3 is a schematic diagram of a basic reversed bandgap voltage reference circuit.

FIG. 3 shows a reversed bandgap reference voltage circuit 10-1, which is a substantial modification of a circuit shown in FIG. 4 in the above-mentioned Widlar reference. The circuit in FIG. 3 includes an NPN transistor Q1 having its emitter connected to ground. A resistor R1 has one terminal connected to the collector of transistor Q1 and one terminal of a current source $I_0$ and has another terminal connected to the base of transistor Q1 and one terminal of a resistor R2. The other terminal of resistor R2 is connected to ground. A second NPN transistor Q2 has its base and collector connected to the collector of transistor Q1. The emitter of transistor Q2 is connected to one terminal of a resistor R3, the other terminal of which is connected to ground. The reversed bandgap output voltage $V_{RBGP}$ is provided on the conductor connecting the emitter of transistor Q2 to resistor R3.

A problem with the circuit 10-1 in FIG. 3 is that transistor Q1 operates in saturation, and therefore causes significant inaccuracy in $V_{RBGP}$. The reversed bandgap voltage reference circuit of FIG. 3 as illustrated is impractical because the current source $I_0$ operates in saturation and therefore is not very accurate. Reversed bandgap reference voltage circuit 10-1 requires a supply voltage of at least 1 volt for operation. Also, the gain characteristic of reversed bandgap circuit 10-1 is so complicated that it is unstable with almost any load.

The reversed bandgap output voltage $V_{RBGP}$ generated by the reversed bandgap reference voltage circuit of FIG. 3 is obtained by dividing both sides of Equation (1) by the $V_{PTAT}$ gain coefficient M. This results in the expression $$V_{RBGP}=V_{BGP}/M=V_{PTAT}+V_{BE}/M\sim(1.2 \text{ volts})\div M\sim 200 \text{ millivolts}. \quad \text{Eq. (2)}$$

Neglecting base currents, the reversed bandgap reference voltage $V_{RBGP}$ is given by the expression $$V_{RBGP} = V_{BE1}\{(R1 + R2)/R2\} - V_{BE2} \quad \text{Eq. (3)}$$

$$= V_{BE1}(R1/R2) + V_T\ln(N)\sim 200 \text{ mV},$$

wherein N is the ratio of current density in transistor Q2 to the current density in transistor Q1, and wherein $V_T$ is the thermal voltage of silicon. The reversed bandgap reference voltage circuit 10-1 of FIG. 3 requires careful selection of the resistor ratios and bias current $I_0$. Its minimum supply voltage $V_{DD}$ is $$V_{DD}(\text{min})=V_{RBGP}+V_{BE2}+V\text{sat} \quad \text{Eq. (4)}$$

where Vsat is the voltage across the current source $I_0$ and can be as small as 10-50 millivolts for a PMOS implementation. The minimum supply voltage $V_{DD}$(min) is 0.85 volts at room temperature, and increases to approximately 1 volt at −40 degrees Centigrade.

The present invention provides various reversed bandgap voltage reference circuit structures wherein all of the important operational circuit parameters are controlled by dedicated feedback loops. In accordance with the reversed bandgap reference voltage circuits of the present invention, a pair of important circuit conditions to be fulfilled are given by the expressions $$I_{C1}=I_{C2}, \text{ and} \quad \text{Eq. (5A)}$$

$$VBE1(1+1/M)=V_{BE2}+V_{RBGP}. \quad \text{Eq. (5B)}$$

In the reversed bandgap reference voltage circuit 10-1 of FIG. 3, the condition of Equation (5B) is satisfied simply by connecting the collector of transistor Q1 to the base of transistor Q2. Therefore, the current source $I_0$ must be designed in such a way that it causes the collector voltage of transistor Q1 to be equal to the base voltage of transistor Q2. However, the ratio $I_{C1}/I_{C2}$ of the collector currents of transistors Q1 and Q2 depends on the values of the current produced by current source $I_0$ and the absolute values of resistors R1, R2 and R3.

In accordance with the present invention, this reliance on absolute component values for the circuit of FIG. 3 is eliminated by means of the feedback circuitry disclosed in the various reversed bandgap voltage reference circuits shown in the following drawings.

Figure 4A:
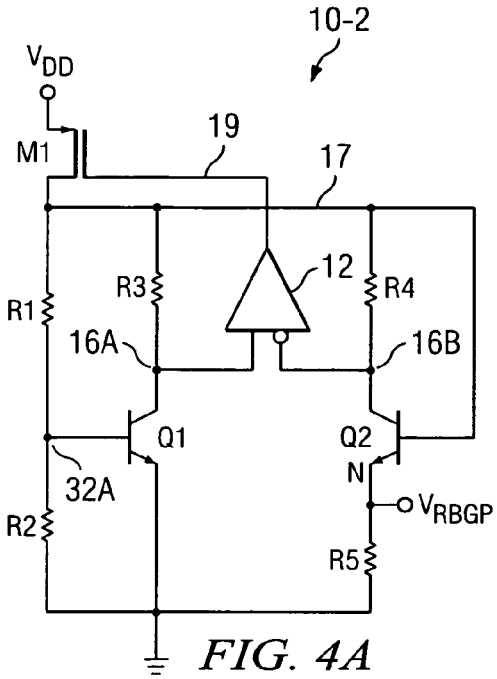
FIG. 4A is a schematic diagram of a reversed bandgap voltage reference circuit of the present invention having a single feedback loop.
Figure 4B:
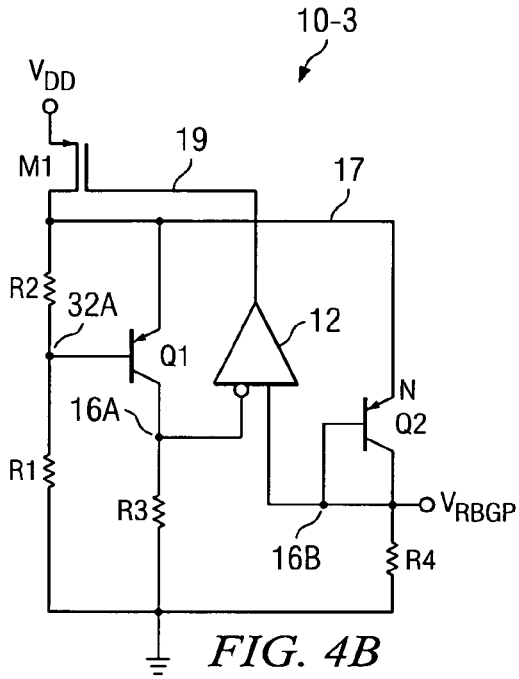
FIG. 4B is a schematic diagram of another reversed bandgap voltage reference circuit of the present invention having a single feedback loop.

Reversed bandgap reference voltage circuits 10-2 and 10-3 shown in FIGS. 4A and 4B, respectively, each use a single feedback loop to control the ratio IC1/IC2. In FIG. 4A, reversed bandgap reference voltage circuit 10-2 includes NPN transistor Q1 having its emitter connected to ground and its base connected by conductor 32A to one terminal of each of resistors R1 and R2. (Note that the resistance values of the various resistors in the drawings are also used as their reference characters.) The other terminal of resistor R2 is connected to ground, and the other terminal of resistor R1 is connected by conductor 17 to one terminal of resistor R3 and one terminal of resistor R4. The other terminal of resistor R3 is connected by conductor 16A to the collector of transistor Q1 and to the non-inverting input of operational amplifier 12. The other terminal of resistor R4 is connected by conductor 16B to the inverting input of operational amplifier 12 and to the collector of transistor Q2. The base of transistor Q2 is also connected to conductor 17. The emitter area of transistor Q2 is N times that of transistor Q1. The output of operational amplifier 12 is connected to the gate of P-channel transistor M1, the source of which is connected to $V_{DD}$ and the drain of which is connected to conductor 17.

In FIG. 4A, the current through transistor Q1 is equal to $V_{RBGP}$/R4. The absolute value of R4 should be chosen to avoid deep saturation of transistor Q2. The absolute value of the current through transistor Q2 is independent of temperature and is equal to IC2=$V_{RBGP}$/R5.

The configuration of reversed bandgap voltage reference circuit 10-3 of FIG. 4B is somewhat similar to that of FIG. 4A. In FIG. 4B, PNP transistor Q1 has its emitter connected to conductor 17 and its base connected by conductor 32A to one terminal of each of resistors R1 and R2. The other terminal of resistor R2 is connected to conductor 17, and the other terminal of resistor R1 is connected to ground. The collector of transistor Q1 is connected by conductor 16A to one terminal of resistor R3 and to the inverting input of operational amplifier 12. The other terminal of resistor R3 is connected to ground. One terminal of resistor R4 is connected by conductor 16B to the non-inverting input of operational amplifier 12 and also to the base and collector of PNP transistor Q2. The emitter of transistor Q2 is connected by conductor 17 to the emitter of transistor Q1 and to the drain of P-channel transistor M1, the source of which is connected to $V_{DD}$. The emitter area of transistor Q2 is N times that of transistor Q1. The output of operational amplifier 12 is connected to the gate of transistor M1.

In the reversed bandgap reference voltage circuits of FIGS. 4A and 4B the condition Equation (5B), that is, $V_{BE1}(1+1/M)=V_{BE2}+V_{RBGP}$, is met by the direct connections of conductor 17 as shown. Specifically, Equation (5B) is met by the direct connection of conductor 17 to the upper terminals of resistors R1 and R3 and to the base of transistor Q2 in FIG. 4A, and by the direct connection by conductor 17 to the upper terminal of resistor R2 and to the emitters of transistors Q1 and Q2 in FIG. 4B. In FIG. 4A, the condition of Equation (5A), i.e., $I_{C1}=I_{C2}$, is met because operational amplifier 12 forces the collector currents to be equal by causing the voltages across, and hence the currents through, matched resistors R3 and R4 to be equal. Similarly, in FIG. 4B the condition of Equation (5A), i.e., $I_{C1}=I_{C2}$, is met because feedback amplifier 12 forces the two collector currents to be equal because the resistances R3 and R4 are equal. (The PTAT gain coefficient M is equal to R2/R1 for FIG. 4A and is equal to R1/R2 for FIG. 4B.)

Figure 8:
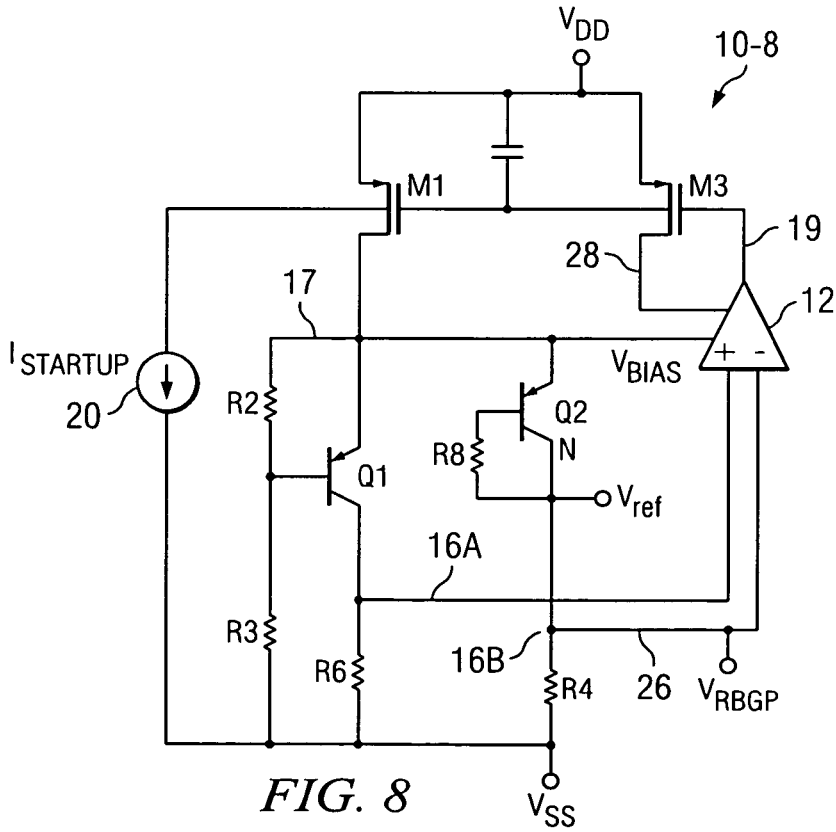
FIG. 8 is a schematic diagram of another reversed bandgap voltage reference circuit of the present invention.
Figure 10:
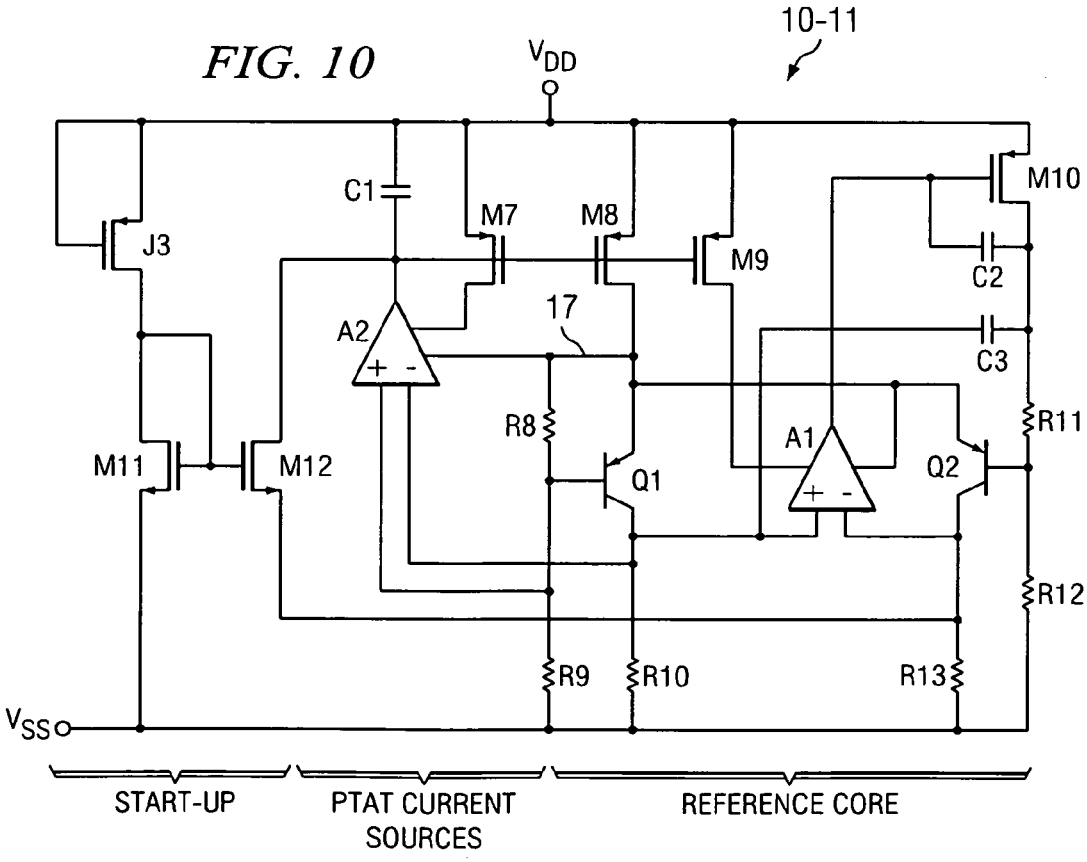
FIG. 10 is a schematic diagram of a detailed implementation of the voltage reference circuit shown in FIG. 7 adapted to provide a scaled output reference voltage.

In FIGS. 4A and 4B, and similarly for the subsequently described bandgap reference voltage circuits of the present invention, the feedback loops create a second stable operating point when all currents in the circuit are equal to zero and therefore require a conventional start-up circuit. FIGS. 8 and 10 show such start-up circuits.

Figure 5A:
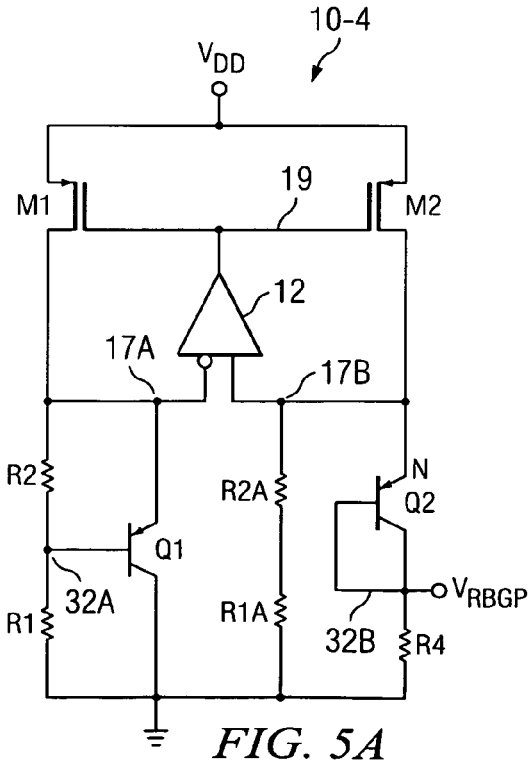
FIG. 5A is a schematic diagram of another reversed bandgap voltage reference circuit of the present invention having a single feedback loop.
Figure 5B:
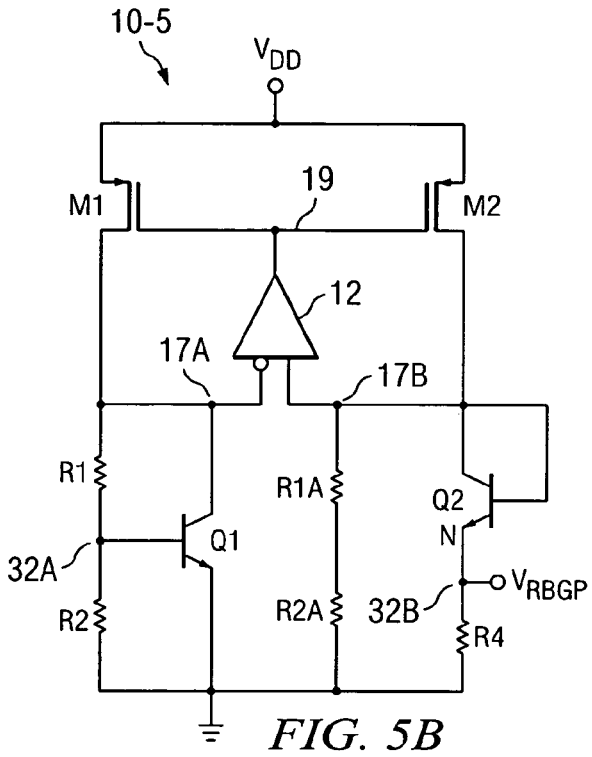
FIG. 5B is a schematic diagram of another reversed bandgap voltage reference circuit of the present invention having a single feedback loop.

Two other reversed bandgap reference voltage circuits are shown in FIGS. 5A and 5B, wherein the requirement of Equation (5A) is met by using PMOS transistors M1 and M2 as matched current sources to establish the collector currents $I_{C1}=I_{C2}$, and feedback loops including an operational amplifier 12 maintains the condition VBE1(1+1/M)=$V_{BE2}+V_{RBGP}$ of Equation (5B).

In FIG. 5A, reversed bandgap voltage reference circuit 10-4 includes NPN transistor Q1 having its collector connected to ground, its base connected by conductor 32A to one terminal of resistor R1 and resistor R2, and its collector connected by conductor 17A to the other terminal of resistor R2, the drain of P-channel transistor M1, and the inverting input of operational amplifier 12. The emitter of NPN transistor Q2 is connected by conductor 17B to the non-inverting input of operational amplifier 12, the drain of P-channel transistor M2, and to one terminal of resistor R2A. The other terminal of resistor R2A is coupled to ground by resistor R1A. The emitter area of transistor Q2 is N times that of transistor Q1. The output of operational amplifier 12 is connected by conductor 19 to the gates of transistors M1 and M2, the sources of which are connected to $V_{DD}$.

The configuration of reversed bandgap voltage reference circuit 10-5 in FIG. 5B is somewhat similar. The emitter of NPN transistor Q1 is connected to ground, its base is connected by conductor 32A to a first terminal of each of resistors R1 and R2, and its collector is connected by conductor 17A to the other terminal of resistor R1, the drain of P-channel transistor M1, and the inverting input of operational amplifier 12. The other terminal of resistor R2 is connected to ground. The emitter and base of NPN transistor Q2 are connected by conductor 17B to the inverting input of operational amplifier 12, the drain of P-channel transistor M2, and to one terminal of resistor R1A, the other terminal of which is coupled by resistor R2A to ground. The emitter of transistor Q2 is connected by conductor 32B is to one terminal of resistor R4, the other terminal of which is connected to ground. The emitter area of transistor Q2 is N times that of transistor Q1. The reversed bandgap voltage $V_{RBGP}$ is produced on conductor 32B. The output of operational amplifier 19 is connected by conductor 19 to the gates of transistors M1 and M2, the sources of which are connected to $V_{DD}$.

In the reversed bandgap reference voltage circuits of both FIGS. 5A and 5B, the requirement of Equation (5B) that VBE1(1+1/M)=$V_{BE2}+V_{RBGP}$ is met because feedback amplifier 12 forces the voltages on conductors 17A and 17B to be equal.

In FIGS. 5A and 5B, if R1=R1A, R2=R2A, and M1=M2, then operational amplifier 12 forces the current produced by transistors M1 and M2 to deliver equal currents into the conductors 17A and 17B. Equal portions of that current therefore flow in the circuit paths R2,R1 and R2A,R1A and therefore $I_{C1}=I_{C2}$, and $V_{RBGP}$ then is defined by Equation (3).

Figure 6:
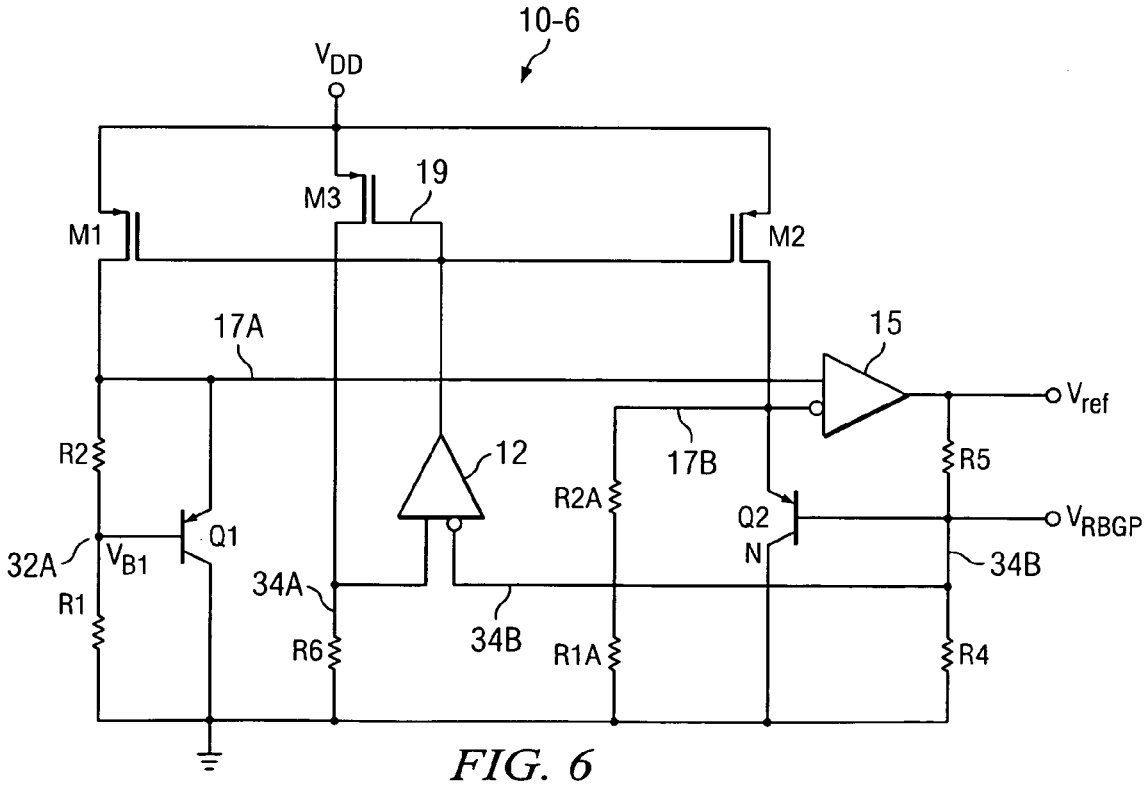
FIG. 6 is a schematic diagram of a reversed bandgap voltage reference circuit of the present invention having two feedback loops.

Note that reversed bandgap reference voltage circuits in FIGS. 4A and 4B and FIGS. 5A and 5B each have only one feedback loop to control either collector currents or voltages to satisfy Equations (5A) and (5B). However, by adding a second feedback loop, both of the above-mentioned circuit operation conditions in Equations (5A) and (5B) can be controlled by feedback. This allows, for example, scaling of the output voltage to a desired value, as shown in FIG. 6. Also, the second feedback loop can establish different TCs for the transistor collector currents to allow $V_{BE}$ curvature compensation.

In FIG. 6, reversed bandgap reference voltage circuit 10-6 includes PNP transistor Q1, which has its collector connected to ground, its base connected by conductor 32A to one terminal of each of resistors R1 and R2, and its collector connected by conductor 17A to the other terminal of resistor R2, the source of P-channel transistor M1, and the non-inverting input of operational amplifier 15. The other terminal of resistor R1 is connected to ground. NPN transistor Q2 has its collector connected to ground, its base connected by conductor 34B to one terminal of each of resistors R4 and R5, and its emitter connected by conductor 17B to the inverting input of operational amplifier 15, to the source of P-channel transistor M2, and to one terminal of resistor R2A. The emitter area of transistor Q2 is N times that of transistor Q1. The other terminal of resistor R4 is connected to ground. The other terminal of resistor R2A is coupled by resistor R1A to ground. The other terminal of resistor R5 is connected to the output of operational amplifier 15. The reversed bandgap voltage $V_{RBGP}$ is produced on conductor 34B.

A scaled-up reference voltage Vref is produced from $V_{RBGP}$ by the output of operational amplifier 15. Conductor 34B also is connected to the inverting input of operational amplifier 12, the output of which is connected by conductor 19 to the gates of P-channel transistors M1, M2, and M3, the sources of which are connected to $V_{DD}$. The drain of transistor M3 is connected by conductor 34A to the non-inverting input of operational amplifier 12 and to one terminal of resistor R6, the other terminal of which is connected to ground.

In the reversed bandgap reference voltage circuit of FIG. 6, amplifier 15 controls the base voltage of transistor Q2 in order to satisfy Equation (5). Bias currents are regulated by amplifier 12 using the temperature-independent voltage $V_{RBGP}$ as a reference. The output voltage Vref can be scaled to a required value given by the expression $$V\text{ref}=V_{RBGP}(R4+R5)/R4. \qquad \text{Eq. (6)}$$

The resistive voltage divider including resistors R5 and R4 controls the base voltage of transistor Q2, and operational amplifier 15 forces the voltages on conductors 17A and 17B to be equal, thereby meeting the requirement VBE1(1+1/M) $=V_{BE2}+V_{RBGP}$ of Equation (5B). The requirement $I_{C1}=I_{C2}$ of Equation (5A) is met by designing transistors M1, M2 and M3 to be perfectly matched so as to deliver equal collector currents, and also by designing the resistances of resistors R4 and R6 to be precisely equal. Operational amplifier 12 establishes the value of the equal currents in matched transistors M1, M2 and M3 to be equal to the currents forced to flow through matched resistors R6 and R4. This occurs as a result of feedback amplifier 12 forcing the voltages on conductors 34 and 34B to be equal.

If both of the previously described circuit operation conditions, rather than just one of them, are controlled using feedback amplifiers, that provides a way of scaling up the reversed bandgap voltage $V_{RBGP}$ to obtain the output reference voltage Vref. This is advantageous, because the reversed bandgap voltage reference circuits shown in FIGS. 4A and 4B and FIGS. 5A and B produce an output voltage $V_{RBGP}$ which is in the range of only 90 to 100 millivolts, whereas reversed bandgap voltage reference circuit 10-6 of FIG. 6 produces a value of Vref of up to 600-900 millivolts. Another advantage of reversed bandgap voltage reference circuit 10-6 is that transistors Q1 and Q2 can be substrate transistors having their collectors formed in the semiconductor wafer substrate, and therefore can be readily implemented in any CMOS process.

Figure 7:
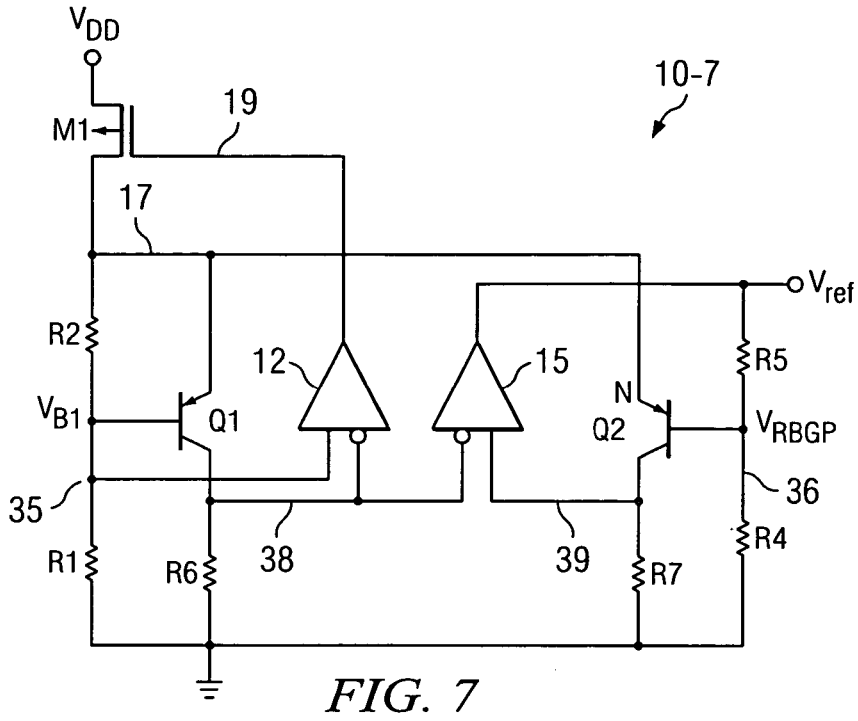
FIG. 7 is a schematic diagram of a reversed bandgap voltage reference circuit of the present invention having dual feedback loop voltage and current control.

Another variant of the dual-feedback reversed bandgap reference is shown in FIG. 7, wherein reversed bandgap reference voltage circuit 10-7 includes PNP transistor Q1 which has its base connected by conductor 35 to one terminal of each of resistors R1 and R2 and to the non-inverting input of operational amplifier 12, its emitter connected by conductor 17 to the emitter of NPN transistor Q2, the source of P-channel transistor M1, and the other terminal of resistor R2. The collector of transistor Q1 is connected by conductor 38 to the inverting input of operational amplifier 12, the input of operational amplifier 15, and one terminal of resistor R6. The other terminal of resistor R1 is connected to ground, and the other terminal of resistor R6 also is connected to ground. The base of transistor Q2 is connected by conductor 36 to one terminal of each of resistors R4 and R5. The collector of transistor Q2 is connected by conductor 39 to one terminal of resistor R7 and to the non-inverting input of operational amplifier 15. The other terminal of resistor R5 is connected to the output of operational amplifier 15, which produces a scaled-up reference voltage Vref. The other terminal of resistor R4 is connected to ground, as is the other terminal of resistor R7. The output of operational amplifier 12 is connected by conductor 19 to the gate of transistor M1, the collector of which is connected to $V_{DD}$. The emitter area of transistor Q2 is N times larger than the emitter area of transistor Q1. The output voltage of the reference in FIG. 7 is defined by Equation (6).

In FIG. 7, the requirement VBE1(1+1/M)$=V_{BE2}+V_{RBGP}$ of Equation (5B) is met by the direct connection of conductor 17 to the emitter of transistor Q2 and to the collector of transistor Q1. The requirement $I_{C1}=I_{C2}$ of Equation (5A) is met by the operation of feedback amplifier 12 to control the current through transistor Q1, thereby causing the voltages on conductors 35 and 38 across equal resistors R1 and R6, respectively, to be equal, and also by the operation of feedback amplifier 15 to cause the collector currents of transistors Q1 and Q2 to be equal by causing the voltages on conductors 38 and 39 across matched resistors R6 and R7, respectively, to be equal.

Figure 9:
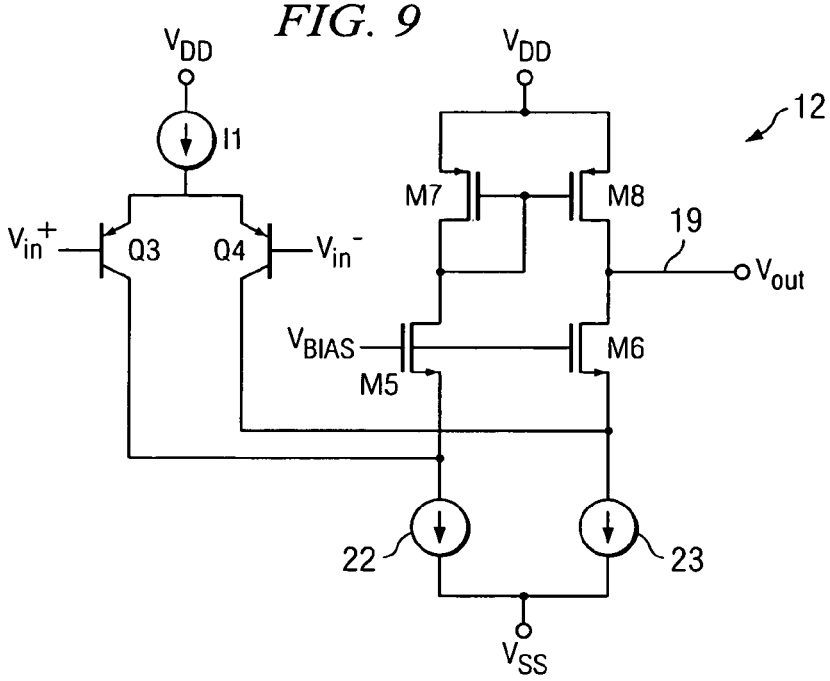
FIG. 9 is a schematic diagram of the feedback amplifier included in FIG. 8.

FIG. 8 shows a practical implementation of the same basic structure as the one shown in FIG. 4B, with amplifier 12 being implemented as shown in FIG. 9 by an input stage including transistors Q3 and Q4 and a folded cascode stage including transistors M5, M6, M7, and M8. P-channel transistor M3 in FIG. 8 is used to implement the tail current source I1 in FIG. 9.

FIG. 10 shows a practical implementation of the basic circuit shown in FIG. 7, further including a conventional start-up circuit, which is formed by P-channel junction field effect transistor J3 and transistors M11 and M12. The start-up circuit is off during normal circuit operation. The capacitors C1, C2, and C3 are frequency compensation capacitors. Amplifiers A1 and A2 can be the same as amplifier 12 shown in FIG. 9.

Figure 1:
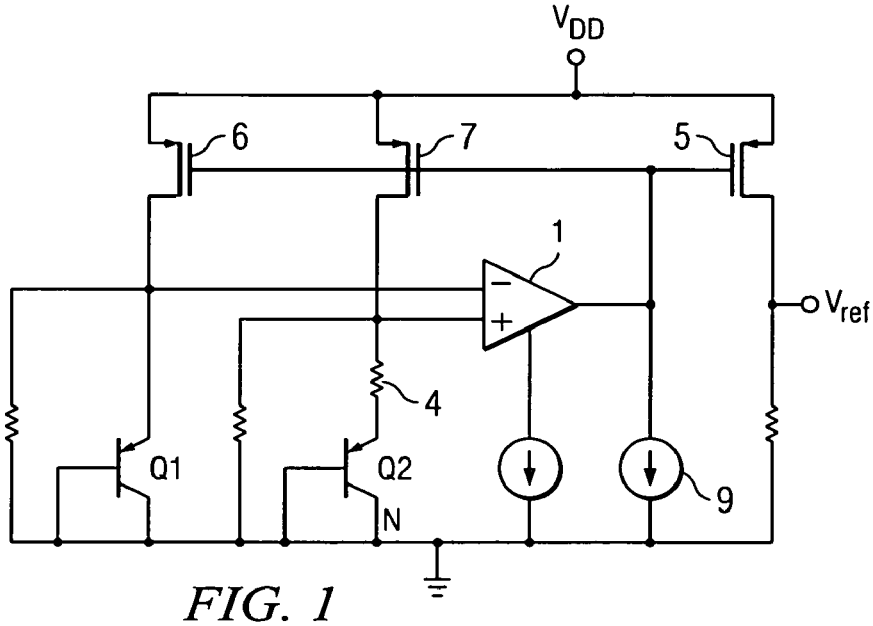
FIG. 1 (PRIOR ART)
FIG. 1 is a schematic diagram of a prior art current mode bandgap reference voltage circuit.
Figure 2:
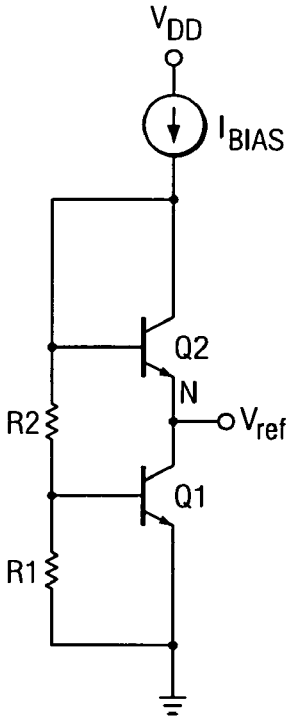
FIG. 2 (PRIOR ART)
FIG. 2 is a schematic diagram of a prior art voltage mode bandgap reference voltage circuit.

The main advantage of the above described invention, especially the embodiments of FIG. 4A through FIG. 10, over the prior art is better accuracy than the prior art bandgap circuits. For example, in Prior Art FIG. 1, the current mirror circuitry generates a great deal of noise, which is avoided by the embodiments of FIG. 4A through FIG. 10 because the current mirror circuitry is outside of the feedback loops. In Prior art FIG. 2, transistor Q1 is in saturation, resulting in low current gain and consequently in low accuracy which is avoided by the embodiments of FIG. 4A through FIG. 10 because none of the bipolar transistors are in or near saturation.

Thus, the described invention provides a set of circuit implementations of reversed bandgap reference voltage circuits which produce low output voltage (~200 millivolts) and which are capable of operating from a supply voltage of less than 1 volt, and which have accuracy and noise parameters comparable with conventional 1.2 volt bandgap voltage references. One of the low voltage reversed bandgap voltage reference circuits, disclosed in FIG. 7, can be implemented using substrate transistors.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, the reversed bandgap reference voltage circuits in FIGS. 4A, 4B and FIG. 7 use resistors for current sensing. This also can be accomplished by other means, such as using MOS current mirrors with low-threshold transistors.

What is claimed is:

1. A circuit for producing a reversed bandgap reference voltage $V_{RBGP}$, comprising:

(a) a first transistor and a second transistor having an emitter area substantially greater than that of the first transistor;

(b) first and second resistors coupled in series between a reference voltage conductor and a first conductor, a base of the first transistor being coupled to a junction between the first and second resistors, for producing a first voltage $V_{BE1}(1+1/M)$ between the first conductor and the reference voltage conductor, wherein $V_{BE1}$ is a base-emitter voltage of the first transistor and M is a ratio of the resistances of the first and second resistors;

(c) a third resistor across which the reversed bandgap reference voltage $V_{RBGP}$ is produced being coupled between the second transistor and the reference voltage conductor, for producing a second voltage $V_{BE2}+V_{RBGP}$ between a second conductor and the reference voltage conductor, wherein $V_{BE2}$ is the base-emitter voltage of the second transistor;

(d) first circuitry coupled to effectuate forcing collector current of the first transistor to be equal to collector current of the second transistor; and (e) second circuitry coupled to effectuate forcing the first voltage $V_{BE1}$ (1+1/M) to be equal the second voltage $V_{BE2}+V_{RBGP}$.

2. The circuit of claim 1 wherein at least one of the first circuitry and second circuitry includes an operational amplifier coupled to effectuate the forcing.

3. The circuit of claim 2 including a start-up circuit coupled to a control terminal of a current source transistor to change the state of the circuit from a zero-current stable state to a stable state in which the circuit produces the reversed bandgap reference voltage $V_{RBGP}$.

4. The circuit of claim 1 wherein the first and second transistors are NPN transistors, an emitter of the second transistor being coupled to a first terminal of the third resistor by means of a conductor conducting the reversed bandgap reference voltage $V_{RBGP}$, a second terminal of the third resistor being coupled to the reference voltage conductor, an emitter of the first transistor being coupled to the reference voltage conductor, wherein the first circuitry includes a first operational amplifier, a P-channel transistor having a gate coupled to an output of the first operational amplifier and a drain coupled by the first conductor to a first terminal of a fourth resistor and a first terminal of a fifth resistor, the fourth resistor having a second terminal coupled to a collector of the first transistor and a first input of the first operational amplifier, the fifth resistor having a second terminal coupled to a collector of the second transistor and a second input of the first operational amplifier, and wherein the second circuitry includes the first conductor coupled to the second conductor and a base of the second transistor.

5. The circuit of claim 1 wherein the first and second transistors are PNP transistors, a collector of the first transistor being coupled to a first terminal of a fourth resistor, a collector and a base of the second transistor being coupled to a first terminal of the third resistor by means of a conductor conducting the reversed bandgap reference voltage $V_{RBGP}$, emitters of the first and second transistors being coupled to the first conductor, wherein the first circuitry includes a first operational amplifier, a P-channel transistor having a gate coupled to an output of the first operational amplifier and a drain coupled to the first conductor, the third and fourth resistors each having a second terminal coupled to the reference voltage conductor, the first terminal of the third resistor being coupled to a first input of the first operational amplifier, and the first terminal of the fourth resistor being coupled to a second input of the first operational amplifier, and wherein the second circuitry includes the first conductor connected to the second conductor and the emitters of the first and second transistors.

6. The circuit of claim 1 wherein the first and second transistors are NP transistors, emitters of the first and second transistors being coupled to the first and second conductors, respectively, a collector of the first transistor being coupled to the reference voltage conductor, a base and collector of the second transistor being coupled by means of a conductor conducting the reversed bandgap reference voltage $V_{RBGP}$ to a first terminal of the third resistor, a second terminal of the third resistor being coupled to the reference voltage conductor, wherein the first circuitry includes matched first and second P-channel transistors, and wherein the second circuitry includes a first operational amplifier, the first and second P-channel transistors having gates coupled to an output of the first operational amplifier, the first P-channel transistor having a drain coupled by the first conductor to a first input of the first operational amplifier, the second P-channel transistor having a drain coupled by the second conductor to a second input of the first operational amplifier.

7. The circuit of claim 6 wherein the first circuitry includes a matching resistance equal to a series resistance of the first and second resistors coupled between the second conductor and the reference voltage conductor.

8. The circuit of claim 1 wherein the first and second transistors are NPN transistors, collectors of the first and second transistors being coupled to the first and second conductors, respectively, an emitter of the first transistor being coupled to the reference voltage conductor, an emitter of the second transistor being coupled by means of a conductor conducting the reversed bandgap reference voltage $V_{RBGP}$ to a first terminal of the third resistor, a second terminal of the third resistor being coupled to the reference voltage conductor, a base and collector of the second transistor being coupled to the second conductor, wherein the first circuitry includes matched first and second P-channel transistors, and wherein the second circuitry includes a first operational amplifier, the first and second P-channel transistors having gates coupled to an output of the first operational amplifier, the first P-channel transistor having a drain coupled by the first conductor to a first input of the first operational amplifier, the second P-channel transistor having a drain coupled by the second conductor to a second input of the first operational amplifier.

9. The circuit of claim 8 wherein the first circuitry includes a matching resistance equal to a series resistance of the first and second resistors coupled between the second conductor and the reference voltage conductor.

10. The circuit of claim 1 wherein the first and second transistors are PNP transistors, emitters of the first and second transistors being coupled to the first and second conductors, respectively, collectors of the first and second transistors being coupled to the reference voltage conductor, a base of the second transistor being coupled by means of a third conductor conducting the reversed bandgap reference voltage $V_{RBGP}$ to a first terminal of the third resistor and a first terminal of a fourth resistor, a second terminal of the third resistor being coupled to the reference voltage conductor, wherein the first circuitry includes matched first and second P-channel transistors and a third P-channel transistor, and a first operational amplifier, the first, second and third P-channel transistors having gates coupled to an output of the first operational amplifier, a drain of the third P-channel transistor being coupled by a fourth conductor to a first input of the first operational amplifier and to a first terminal of a fifth resistor having a second terminal coupled to the ground reference voltage, a second input of the first operational amplifier being coupled to the third conductor, and wherein the second circuitry includes a second operational amplifier, the first P-channel transistor having a drain coupled by the first conductor to a first input of the second operational amplifier, the second P-channel transistor having a drain coupled by the second conductor to a second input of the second operational amplifier, an output of the second operational amplifier being coupled to a second terminal of the fourth resistor by means of an output conductor conducting a scaled-up voltage representative of the reversed bandgap voltage $V_{RBGP}$.

11. The circuit of claim 10 wherein the first circuitry includes a matching resistance equal to a series resistance of the first and second resistors coupled between the second conductor and the reference voltage conductor.

12. The circuit of claim 10 wherein the first inputs of the first and second operational amplifiers are non-inverting inputs.

13. The circuit of claim 1 wherein the first and second transistors are PNP transistors, emitters of the first and second transistors being coupled to the first conductor, a collector of the first transistor being coupled to a first terminal of a fourth resistor, a collector of the second transistor being coupled to a first terminal of a fifth resistor, wherein the first circuitry includes a first operational amplifier, a P-channel transistor having a gate coupled to an output of the first operational amplifier and a drain coupled to the first conductor, the third, fourth, and fifth resistors each having a second terminal coupled to the reference voltage conductor, the first terminal of the fourth resistor being coupled to a first input of the first operational amplifier, a first terminal of the first resistor being coupled to a base of the first transistor and a second input of the first operational amplifier, wherein the first circuitry also includes a second operational amplifier having a first input coupled to the first terminal of the fourth resistor and a second input coupled to the first terminal of the fifth resistor, an output of the second operational amplifier being coupled to a first terminal of a sixth resistor by means of a conductor conducting a scaled-up voltage representative of the reversed bandgap voltage $V_{RBGP}$, the sixth resistor having a second terminal coupled to the first terminal of the third resistor, and wherein the second circuitry includes the first conductor connected to the second conductor and the emitters of the first and second transistors.

14. The circuit of claim 13 wherein the first and second transistors are substrate transistors.

15. The circuit of claim 1 wherein a value of the third resistor is sufficiently low to prevent saturation of the second transistor.

16. A method for producing a reversed bandgap reference voltage $V_{RBGP}$, comprising:

(a) providing a first transistor and a second transistor having an emitter area substantially greater than that of the first transistor;

(b) producing a first voltage $V_{BE1}(1+1/M)$ between a first conductor and a reference voltage conductor, wherein $V_{BE1}$ is a base-emitter voltage of the first transistor and M is a ratio of resistances of first and second resistors coupled in series between the reference voltage conductor and the first conductor;

(c) producing a second voltage $V_{BE2}+V_{RBGP}$ between a second conductor and the reference voltage conductor, wherein $V_{BE2}$ is a base-emitter voltage of the second transistor, a third resistor across which the reversed bandgap reference voltage $V_{RBGP}$ is produced being coupled between the second transistor and the reference voltage conductor;

(d) forcing collector current of the first transistor to be equal to collector current of the second transistor; and (e) forcing the first voltage $V_{BE1}(1+1/M)$ to be equal to the second voltage $V_{BE2}+V_{RBGP}$.

17. The method of claim 16 including performing at least one of the forcing steps by means a feedback operational amplifier.

18. The method of claim 16 including preventing either of the first and second transistors from operating in its saturated region.

19. A circuit for producing a reversed bandgap reference voltage $V_{RBGP}$, comprising:

(a) a first transistor and a second transistor having an emitter area substantially greater than that of the first transistor;

(b) means for producing a first voltage $V_{BE1}(1+1/M)$ between a first conductor and a reference voltage conductor, wherein $V_{BE1}$ is a base-emitter voltage of the first transistor and M is a ratio of resistances of first and second resistors coupled in series between the reference voltage conductor and the first conductor;

(c) means for producing a second voltage $V_{BE2}+V_{RBGP}$ between a second conductor and the reference voltage conductor, wherein $V_{BE2}$ is a base-emitter voltage of the second transistor, a third resistor across which the reversed bandgap reference voltage $V_{RBGP}$ is produced being coupled between the second transistor and the reference voltage conductor;

(d) means for forcing collector current of the first transistor to be equal to collector current of the second transistor; and (e) means for forcing the first voltage $V_{BE1}(1+1/M)$ to be equal to the second voltage $V_{BE2}+V_{RBGP}$.

20. The circuit of claim 19 wherein at least one of the forcing means includes feedback amplifier circuitry.

* * * * *